US009778616B2

(12) United States Patent
Hiramatsu et al.

(10) Patent No.: US 9,778,616 B2
(45) Date of Patent: Oct. 3, 2017

(54) PROCESS CARTRIDGE

(71) Applicant: CANON KABUSHIKI KAISHA, Tokyo (JP)

(72) Inventors: Daisuke Hiramatsu, Tokyo (JP); Kiyoshi Furuta, Suntou-gun (JP); Takatoshi Hamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/194,785

(22) Filed: Jun. 28, 2016

(65) Prior Publication Data

US 2017/0003646 A1 Jan. 5, 2017

(30) Foreign Application Priority Data

Jul. 1, 2015 (JP) ..... 2015-133020

(51) Int. Cl.
*G03G 21/16* (2006.01)
*G03G 21/18* (2006.01)

(52) U.S. Cl.
CPC ..... *G03G 21/1842* (2013.01); *G03G 21/185* (2013.01); *G03G 21/1846* (2013.01)

(58) Field of Classification Search
CPC ..... G03G 21/1842; G03G 21/1846; G03G 21/185
USPC ..... 399/111
See application file for complete search history.

(56) References Cited

U.S. PATENT DOCUMENTS

| | | | | |
|---|---|---|---|---|
| 5,559,581 | A | 9/1996 | Sugiura et al. | |
| 5,561,496 | A | 10/1996 | Sugiura et al. | |
| 5,634,178 | A | 5/1997 | Sugiura et al. | |
| 6,084,622 | A | 7/2000 | Sugiura et al. | |
| 8,712,285 | B2 * | 4/2014 | Kato | G03G 15/0189 399/110 |
| 9,164,424 | B2 | 10/2015 | Nakamura et al. | |
| 2008/0124105 | A1 * | 5/2008 | Okamoto | G03G 15/0872 399/51 |
| 2008/0226337 | A1 * | 9/2008 | Han | G03G 21/1846 399/111 |
| 2015/0205226 | A1 | 7/2015 | Komatsu et al. | |

FOREIGN PATENT DOCUMENTS

JP 2002-328586 A 11/2002

* cited by examiner

*Primary Examiner* — Hoang Ngo
(74) *Attorney, Agent, or Firm* — Fitzpatrick, Cella, Harper & Scinto

(57) ABSTRACT

A rotational axis line of the image bearing member is parallel to a pivotal axis line of the handle. When the handle is grasped, the process cartridge body in a non-used state is inclined so that the image bearing member is positioned upward relative to a horizontal surface, and the process cartridge body from which developer has been consumed is inclined so that the image bearing member is positioned downward relative to the horizontal surface.

7 Claims, 10 Drawing Sheets

PROCESS CARTRIDGE

BACKGROUND OF THE INVENTION

Field of the Invention

The present invention relates to a process cartridge capable of being detachably attached to an apparatus body of an image forming apparatus.

Description of the Related Art

An image forming apparatus which uses an electrophotographic technique generally requires maintenance of various process means, replenishment of toner, and other operations. A process cartridge is known in which a process means such as a photosensitive drum, a charging means, a developing means, and a cleaning means are integrated as a cartridge in order to perform replenishment of toner, maintenance, and other operations easily. The process cartridge is capable of being detachably attached to an apparatus body of an image forming apparatus. A user can easily perform maintenance of process means, replenishment of toner, and other operations by replacing the process cartridge.

Moreover, a process cartridge is proposed in which a handle for allowing a user to easily replace and carry the process cartridge is formed on a frame of the process cartridge (see Japanese Patent Application Publication No. 2002-328586). This handle is pivotably relative to the process cartridge body. The pivotal axis line of the handle is positioned so as to overlap the center of gravity of the process cartridge body when seen from a vertical direction in an attitude (hereinafter referred to as an attached attitude) when the process cartridge is attached to an image forming apparatus body in a state in which the image forming apparatus is installed on a horizontal surface.

Here, the process cartridge body is a portion of the process cartridge excluding the handle. Since the pivotal axis line of the handle is positioned in this manner, it is possible to maintain the attitude of the process cartridge in the attached attitude when a user grasps the handle to carry the process cartridge.

However, since the amount of toner in the process cartridge decreases with the use of the process cartridge, the position of the center of gravity of the process cartridge body may move before and after the use of the same process cartridge. Here, FIGS. 10A and 10B are diagrams illustrating the state of a process cartridge when a handle provided in a conventional process cartridge is grasped. FIG. 10A is a diagram illustrating the state of the process cartridge before use. Moreover, FIG. 10B is a diagram illustrating the state of the process cartridge after use.

As illustrated in FIGS. 10A and 10B, the center of gravity of the process cartridge body may be shifted by distance Z before and after the use of the process cartridge. In the technique disclosed in Japanese Patent Application Publication No. 2002-328586, the pivotal axis line of the handle is positioned so as to overlap the center of gravity of the process cartridge body when seen from the vertical direction in an attached attitude of the process cartridge. Thus, in the technique disclosed in Japanese Patent Application Publication No. 2002-328586, when a user grasps the handle of the process cartridge after use, the process cartridge is greatly inclined relative to the attached attitude.

SUMMARY OF THE INVENTION

An object of the present invention is to provide a process cartridge capable of being detachably attached to an apparatus body of an image forming apparatus, comprising:

a process cartridge body having a rotatable image bearing member on which a developer image is formed; and a handle provided on the process cartridge body so as to be pivotal relative to the process cartridge body, wherein a rotational axis line of the image bearing member is parallel to a pivotal axis line of the handle, and when the handle is grasped, the process cartridge body in a non-used state is inclined so that the image bearing member is positioned upward relative to a horizontal surface, and the process cartridge body, from which developer has been consumed, is inclined so that the image bearing member is positioned downward relative to the horizontal surface.

Another object of the present invention is to provide a process cartridge capable of being detachably attached to an apparatus body of an image forming apparatus, comprising:

a process cartridge body having a rotatable image bearing member on which a developer image is formed; and a handle provided on the process cartridge body so as to be pivotal relative to the process cartridge body, wherein when seen from a vertical direction in an attached attitude of the process cartridge body when the process cartridge body is attached to the apparatus body, a first center of gravity, which is a center of gravity of the process cartridge body in a non-used state is positioned closer to one side than a pivotal center line of the handle, and a second center of gravity, which is a center of gravity of the process cartridge body from which developer has been consumed is positioned closer to the other side than a pivotal axis line of the handle.

Further features of the present invention will become apparent from the following description of exemplary embodiments (with reference to the attached drawings).

DESCRIPTION OF THE EMBODIMENTS

Hereinafter, exemplary embodiments of the present invention will be described with reference to the accompanying drawings. However, dimensions, materials, shapes, relative positions, and the like of constituent components described in the embodiment are changed appropriately according to a configuration and various conditions of an apparatus to which the present invention is applied. That is, the scope of the present invention is not limited to the following embodiments.

<Overall Configuration of Image Forming Apparatus>

Figure 1:
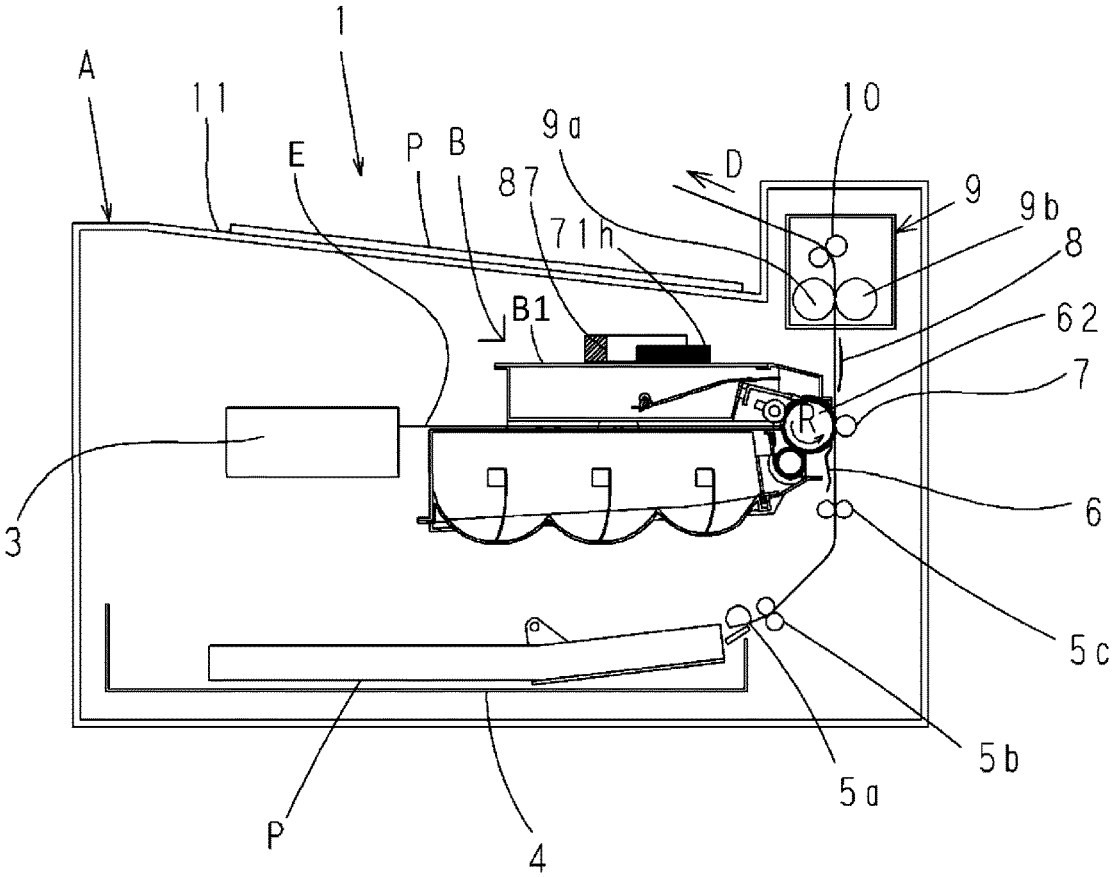
FIG. 1 is a schematic cross-sectional view of an image forming apparatus according to an embodiment.

An embodiment will be described. FIG. 1 is a schematic cross-sectional view of an image forming apparatus 1 according to the embodiment. Here, an axial direction of the rotational axis line of a photosensitive drum 62 (an image bearing member) is defined as a longitudinal direction. In this longitudinal direction, a side on which the photosensitive drum 62 receives the driving force from an apparatus body A of the image forming apparatus 1 is defined as a driving side, and the opposite side of the driving side is defined as a non-driving side. Here, the apparatus body A of the image forming apparatus 1 is a portion of the image forming apparatus 1 excluding a cartridge B (a process cartridge). The image forming apparatus 1 is a laser beam printer which uses an electrophotographic technique. In the image forming apparatus 1, the cartridge B is capable of being detachably attached to the apparatus body A. Moreover, a sheet tray 4 that stores a recording medium (hereinafter referred to as a sheet material P) on which an image is formed is disposed on a lower side of the cartridge B.

In the apparatus body A, a pickup roller 5*a*, a feed roller pair 5*b*, a conveying roller pair 5*c*, a transfer guide 6, a transfer roller 7 (a transfer member), a conveying guide 8, a fixing device 9, a discharge roller pair 10, and a discharge tray 11 are sequentially disposed in a conveying direction D of the sheet material P. The fixing device 9 includes a heating roller 9*a* and a pressure roller 9*b*.

<Image Forming Process>

Next, an image forming process will be described. First, when the image forming apparatus 1 receives a print start signal, the photosensitive drum 62 is driven rotate in the direction indicated by arrow R in FIG. 1. A charging roller 66 (a charging member) (see FIG. 2) to which a bias voltage is applied uniformly charges an outer circumferential surface of the photosensitive drum 62 by making contact with the outer circumferential surface of the photosensitive drum 62. An exposure device 3 outputs a laser beam E to the photosensitive drum 62 according to image information.

The laser beam E passes through a gap between a developing container 23 (see FIG. 2) and a cleaning frame 71 (see FIG. 2) of the cartridge B and scans and exposes the outer circumferential surface of the photosensitive drum 62. In this way, an electrostatic latent image corresponding to the image information is formed on the outer circumferential surface of the photosensitive drum 62. Here, in the present embodiment, the photosensitive drum 62 is disposed at a position that a user can touch in a state in which the cartridge B is detached from the apparatus body A of the image forming apparatus 1.

On the other hand, in a developing unit 20 (a developing apparatus), toner T in a toner chamber 29 (a toner storage chamber) is delivered to a toner supply chamber 28 by being stirred and conveyed when a first conveying member 43, a second conveying member 44, and a third conveying member 50 rotate. The toner T delivered to the toner supply chamber 28 is borne on a surface of a developing roller 32 (a developer bearing member) by the magnetic force of a magnet roller 34 (a fixed magnet). The toner T borne on the developing roller 32 is triboelectrically charged by the developing blade 42 and the thickness of the toner T borne on the developing roller 32 is regulated to a constant thickness. The toner T borne on the developing roller 32 is supplied to the photosensitive drum 62, whereby the electrostatic latent image formed on the photosensitive drum 62 (the image bearing member) is developed as a toner image (a developer image).

Moreover, as illustrated in FIG. 1, the sheet material P stored in a lower portion of the apparatus body A is fed from the sheet tray 4 by the pickup roller 5*a*, the feed roller pair 5*b*, and the conveying roller pair 5*c* in synchronization with the timing at which the laser beam E is output. Moreover, the sheet material P, which has been fed, is guided to the transfer guide 6 and is conveyed to a transfer position which is a nip portion between the photosensitive drum 62 and the transfer roller 7. At this transfer position, the toner image is transferred from the photosensitive drum 62 to the sheet material P.

Figure 2:
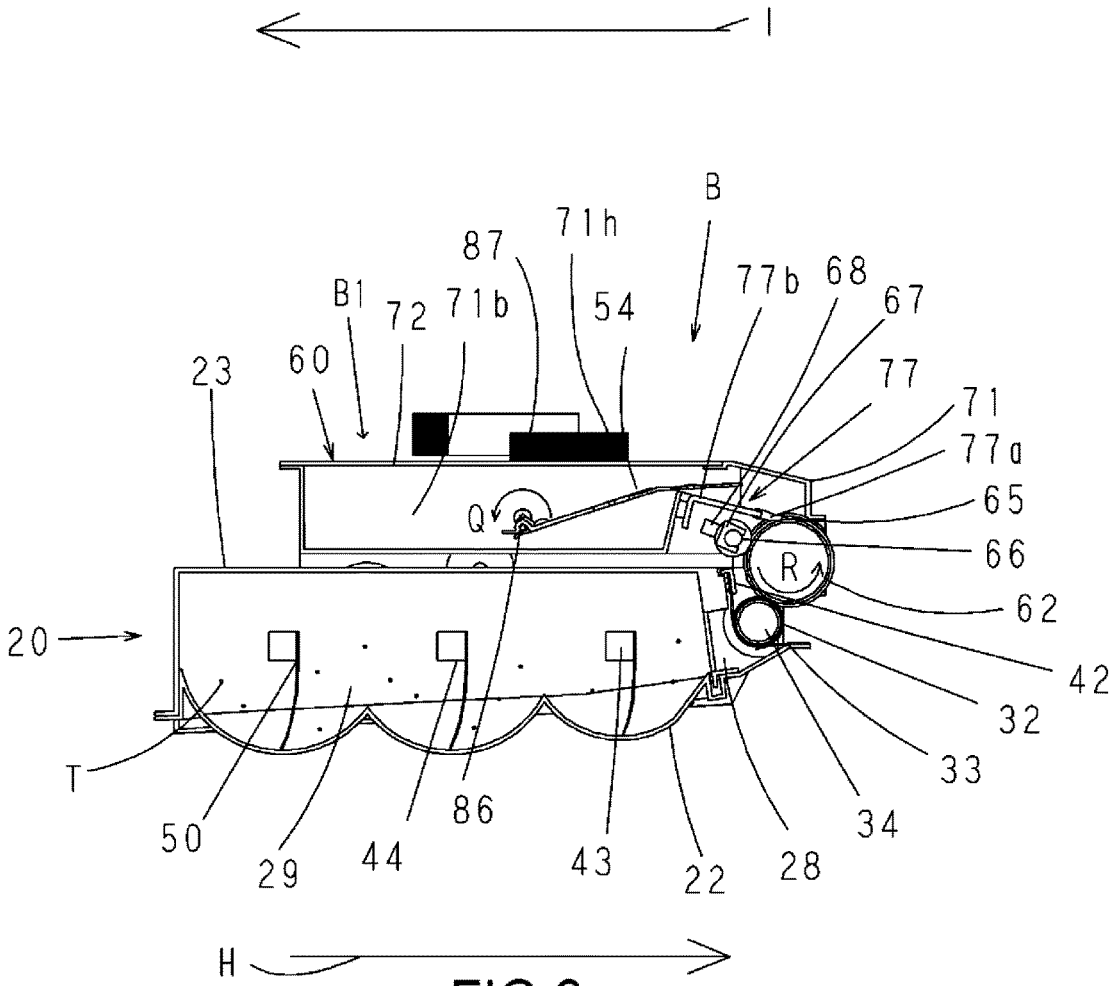
FIG. 2 is a schematic cross-sectional view of the process cartridge according to the embodiment.

The sheet material P to which the toner image is transferred is guided to the conveying guide 8 and is conveyed to the fixing device 9. Moreover, the sheet material P passes through the nip portion between the heating roller 9*a* and the pressure roller 9*b* of the fixing device 9. At this nip portion, the sheet material P is pressurized and heated whereby the toner image is fixed to the sheet material P. The sheet material P to which the toner image is fixed is discharged to the discharge tray 11 by the discharge roller pair 10. On the other hand, as illustrated in FIG. 2, the toner remaining on the photosensitive drum 62 after the toner image is transferred is removed by a cleaning member 77. The removed toner is used again to form a toner image. The toner removed from the photosensitive drum 62 is stored in a waste toner chamber 71*b* (a waste toner storage chamber) of a cleaning unit 60.

<Overall Configuration of Cartridge B>

Figure 3:
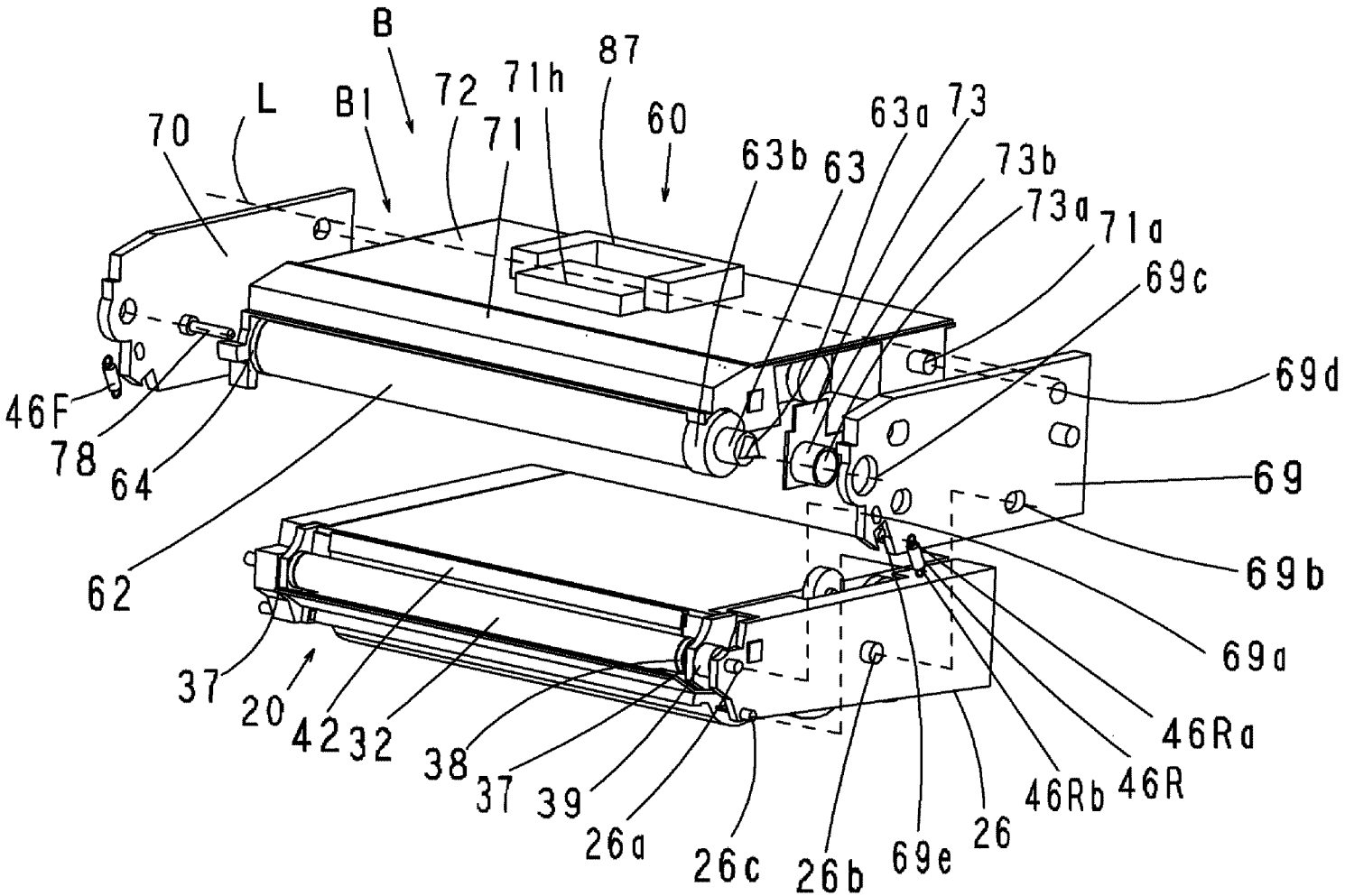
FIG. 3 is a diagram illustrating a configuration of the process cartridge according to the embodiment.
Figure 4:
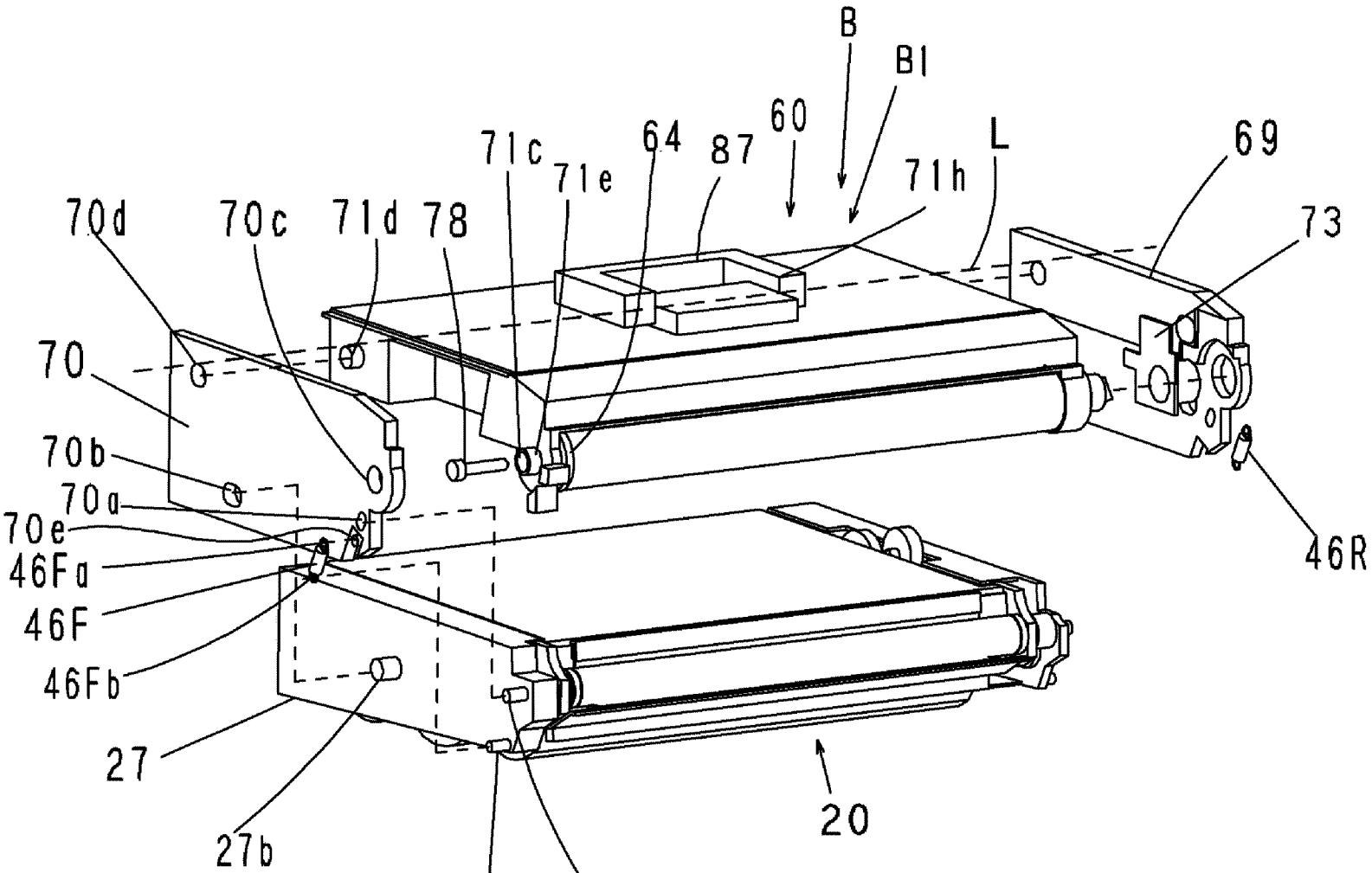
FIG. 4 is a diagram illustrating a configuration of the process cartridge according to the embodiment.

Next, an overall configuration of the cartridge B will be described with reference to FIGS. 2 to 4. FIG. 2 is a schematic cross-sectional view of the cartridge B according to the embodiment. FIG. 3 is a diagram illustrating a configuration of the cartridge B according to the embodiment. FIG. 4 is a diagram illustrating a configuration of the cartridge B according to the embodiment. In the present embodiment, description of screws for coupling respective components will not be provided.

The cartridge B according to the present embodiment will be described with reference to FIG. 2. The cartridge B includes the cleaning unit 60 and the developing unit 20. In general, a process cartridge is a cartridge in which a photosensitive drum is integrated with at least one of a charging means and a cleaning means which are process means acting on the photosensitive drum. Moreover, the process cartridge is capable of being detachably attached to an apparatus body of an image forming apparatus.

In the cartridge B, when waste toner is conveyed into the cleaning unit 60, the toner in the developing unit 20 is conveyed and consumed, whereby the center of gravity of a cartridge body B1 (a process cartridge body) moves before and after the use. Here, the cartridge body B1 is a portion of the cartridge B excluding a handle 87. In FIG. 2, a direction in which the toner in the developing unit 20 is conveyed is the direction H, and a direction in which the waste network in the cleaning unit 60 is conveyed is the direction I.

Due to this, the center of gravity of the cartridge body B1 moves from the center X (a first center) of the cartridge body B1 before use to the center Y (a second center) of the cartridge body B1 after use. That is, in use of the cartridge body B1, the center of gravity of the cartridge body B1 moves so as to approach the photosensitive drum 62. Here, the center Y of the cartridge body B1 is the center of gravity of the cartridge body B1 when the toner in the cartridge body B1 has been consumed.

The cleaning unit 60 includes the photosensitive drum 62, the charging roller 66, the cleaning member 77, the cleaning frame 71 supporting these components, and a lid member 72 fixed to the cleaning frame 71 by welding or the like. The charging roller 66 and the cleaning member 77 are disposed so as to make contact with the outer circumferential surface of the photosensitive drum 62. The cleaning member 77 includes a rubber blade member 77*a* having a blade shape and formed of rubber, which is an elastic member, and a supporting member 77*b*, which supports the rubber blade member 77*a*.

The rubber blade member 77*a* is in abutting contact with the photosensitive drum 62 in a counter direction relative to the rotation direction of the photosensitive drum 62. That is, the rubber blade member 77*a* is in abutting contact with the photosensitive drum 62 so that the distal end of the rubber blade member 77*a* faces the upstream side in the rotation direction of the photosensitive drum 62. The toner removed from the surface of the photosensitive drum 62 by the cleaning member 77 is conveyed to the waste toner chamber 71*b* formed of the cleaning frame 71 and the lid member 72 by a waste toner conveying member 54 (a second conveying member). The waste toner conveying member 54 engages with a crank member 86. When driving force is transmitted from the crank member 86 to the waste toner conveying member 54, the waste toner conveying member 54 rotates in the direction indicated by arrow Q in FIG. 2 to convey toner to the waste toner chamber 71*b*.

Moreover, a scooping sheet 65 for preventing leakage of toner from the waste toner chamber 71*b* is formed at the edge of the cleaning frame 71 so as to make abutting contact with the photosensitive drum 62. Moreover, when driving force of a body driving motor (not illustrated) which is a driving source is transmitted to the photosensitive drum 62, the photosensitive drum 62 is driven to rotate in the direction indicated by arrow R in FIG. 2 according to an image forming operation. The charging roller 66 is attached near both ends in the longitudinal direction (the direction approximately parallel to the axial direction of the rotational axis line of the photosensitive drum 62) of the cleaning frame 71 so as to be rotatable with the aid of a charging roller bearing 67. A biasing member 68 presses the charging roller bearing 67 toward the photosensitive drum 62, whereby the charging roller 66 presses the photosensitive drum 62. Moreover, the charging roller 66 rotates following the rotation of the photosensitive drum 62.

The developing unit 20 includes the developing roller 32, the developing container 23 that supports the developing roller 32, the developing blade 42, and the like. The magnet roller 34 is provided inside the developing roller 32. Moreover, the developing blade 42 regulates the thickness of a toner layer borne on the developing roller 32. An interval maintaining member 38 (see FIG. 3) is attached to both ends of the developing roller 32 in the axial direction of the rotational axis line of the developing roller 32. The interval maintaining member 38 makes abutting contact with the photosensitive drum 62 to form a small gap between the developing roller 32 and the photosensitive drum 62.

Moreover, a blowout preventing sheet 33 for preventing toner from blowing out from the developing unit 20 is attached to the edge of a bottom member 22 so as to make abutting contact with the developing roller 32. Further, the first, second, and third conveying members 43, 44, and 50 (these members correspond to a first conveying member) are provided in the toner chamber 29 formed by the developing container 23 and the bottom member 22. The first, second, and third conveying members 43, 44, and 50 stir and convey the toner stored in the toner chamber 29 to the toner supply chamber 28.

As illustrated in FIGS. 3 and 4, the cartridge B is configured by coupling the cleaning unit 60 and the developing unit 20. A drum bearing 73 that rotatably supports the photosensitive drum 62, the cleaning frame 71, the lid member 72, the photosensitive drum 62, and a drum shaft 78 are provided in the cleaning unit 60. A driving-side drum flange 63 provided on the driving side is inserted into a hole 73*a* of the drum bearing 73 whereby the photosensitive drum 62 is rotatably supported. Moreover, on the non-driving side (see FIG. 4), the drum shaft 78 is press-fitted to a hole 71*c* formed in the cleaning frame 71 to rotatably support a hole (not illustrated) of anon-driving-side drum flange 64. Moreover, a flange gear portion 63*b* that transmits the driving force to a developing roller gear 39 provided on the driving side of the developing roller 32 is provided in the driving-side drum flange 63.

A driving-side drum side member 69 and a non-driving-side drum side member 70 for supporting the developing unit 20 are provided on both end sides of the cleaning frame 71. A boss 71*a* provided on the driving side of the cleaning frame 71 is inserted into a long hole 69*d* formed in the driving-side drum side member 69. Moreover, a supporting portion 73*b* of the drum bearing 73 attached to the cleaning frame 71 is inserted into a positioning hole 69*c* formed in the driving-side drum side member 69. In this way, the driving-side drum side member 69 is fixed to the cleaning frame 71.

A boss 71*d* formed on the non-driving side of the cleaning frame 71 is inserted into a long hole 70*d* formed in the non-driving-side drum side member 70. Moreover, an outer diameter portion 71*e* of a cylindrical boss in which the drum shaft 78 is inserted is inserted into a positioning hole 70*c* formed in the non-driving-side drum side member 70. In this way, the non-driving-side drum side member 70 is fixed to the cleaning frame 71.

On the other hand, the developing unit 20 includes the bottom member 22 (see FIG. 2), the developing container 23 (see FIG. 2), a driving-side developing side member 26 (see FIG. 3), a non-driving-side developing side member 27 (see FIG. 4), the developing roller 32, and the developing blade 42. The developing roller 32 is rotatably attached to the developing container 23 with be a ring members 37 provided on both end sides of the developing roller 32 interposed. Moreover, the driving-side drum side member 69 and the non-driving-side drum side member 70 are slidably coupled whereby the developing unit 20 and the cleaning unit 60 are coupled. The cartridge B is configured of the developing unit 20 and the cleaning unit 60.

On one end side in the longitudinal direction of the developing unit 20, a first developing supporting portion 26*a* and a second developing supporting portion 26*b* are formed on the driving-side developing side member 26. Moreover, on the other end side in the longitudinal direction of the developing unit 20, a third developing supporting portion 27*a* and a fourth developing supporting portion 27*b* are formed on the non-driving-side developing side member 27. Moreover, the first developing supporting portion 26*a* formed on the driving-side developing side member 26 is inserted into a first long hole 69*a* formed in the driving-side drum side member 69. The second developing supporting portion 26*b* formed on the driving-side developing side member 26 is inserted into a second long hole 69*b* formed in the driving-side drum side member 69.

Moreover, the third developing supporting portion 27*a* formed on the non-driving-side developing side member 27 is inserted into a third long hole 70*a* formed in the non-driving-side drum side member 70. The fourth developing supporting portion 27*b* formed on the non-driving-side developing side member 27 is inserted into a fourth long hole 70*b* formed in the non-driving-side drum side member 70. In this manner, the driving-side drum side member 69 and the non-driving-side drum side member 70 are coupled whereby the developing unit 20 and the cleaning unit 60 are coupled.

Moreover, a first engagement portion 46Ra of a driving-side biasing member 46R is attached to a boss 69*e* of the driving-side drum side member 69. A second engagement portion 46Rb of the driving-side biasing member 46R is attached to a boss 26*c* of the driving-side developing side member 26. Moreover, a first engagement portion 46Fa of a non-driving-side biasing member 46F is attached to a boss 70*e* of the non-driving-side drum side member 70. A second engagement portion 46Fb of the non-driving-side biasing member 46F is caught at a boss 27*c* of the non-driving-side developing side member 27.

In the present embodiment, the driving-side biasing member 46R and the non-driving-side biasing member 46F are metallic tension springs and are configured to press the developing unit 20 against the cleaning unit 60 with the biasing force of the spring. Due to this, the developing roller 32 is reliably pressed toward the photosensitive drum 62. Moreover, due to the interval maintaining member 38 attached to both ends of the developing roller 32, a predetermined interval is formed between the developing roller 32 and the photosensitive drum 62.

<Cartridge Attachment and Detachment Operation>

Figure 5:
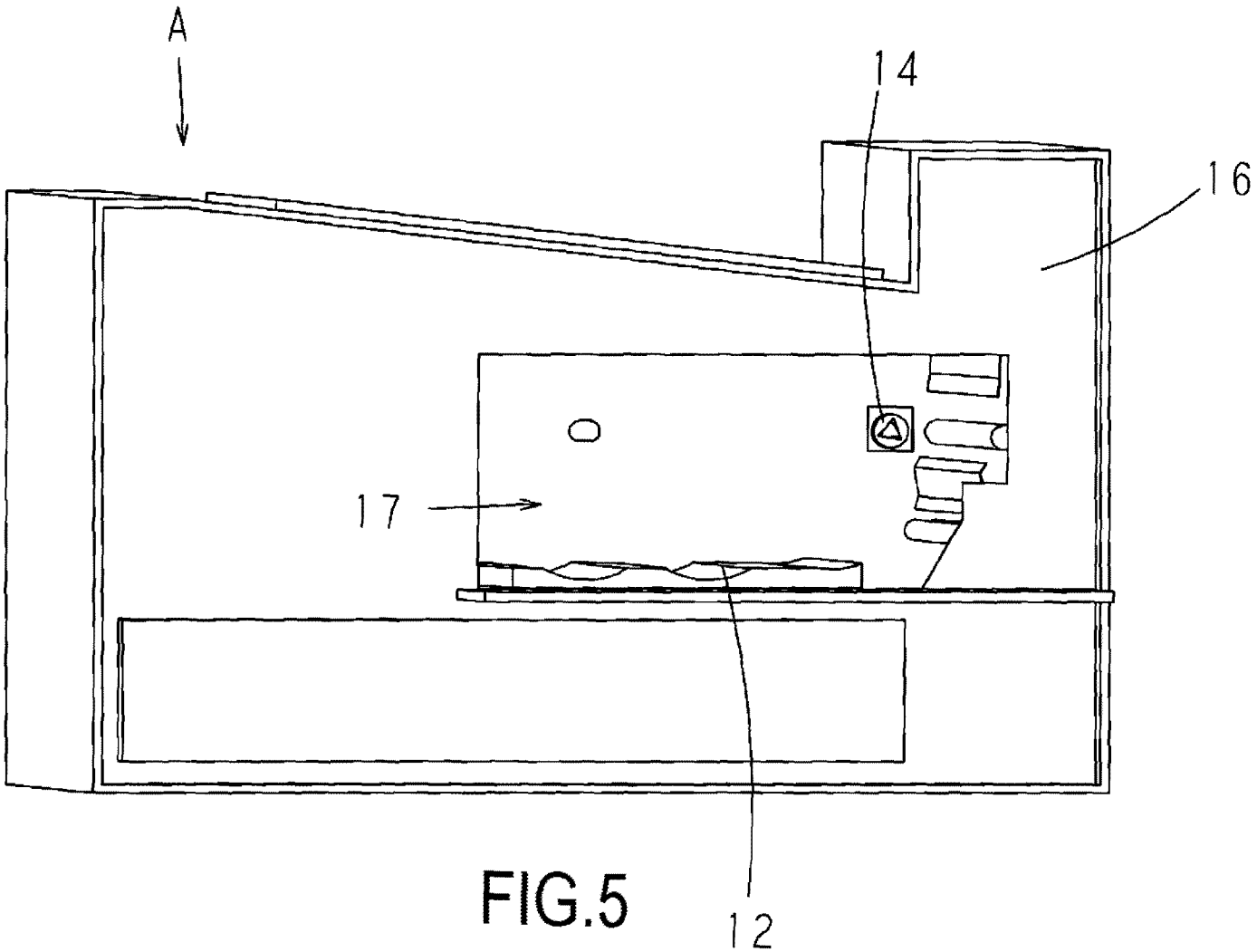
FIG. 5 is a perspective view of an apparatus body of an image forming apparatus according to an embodiment.
Figure 6:
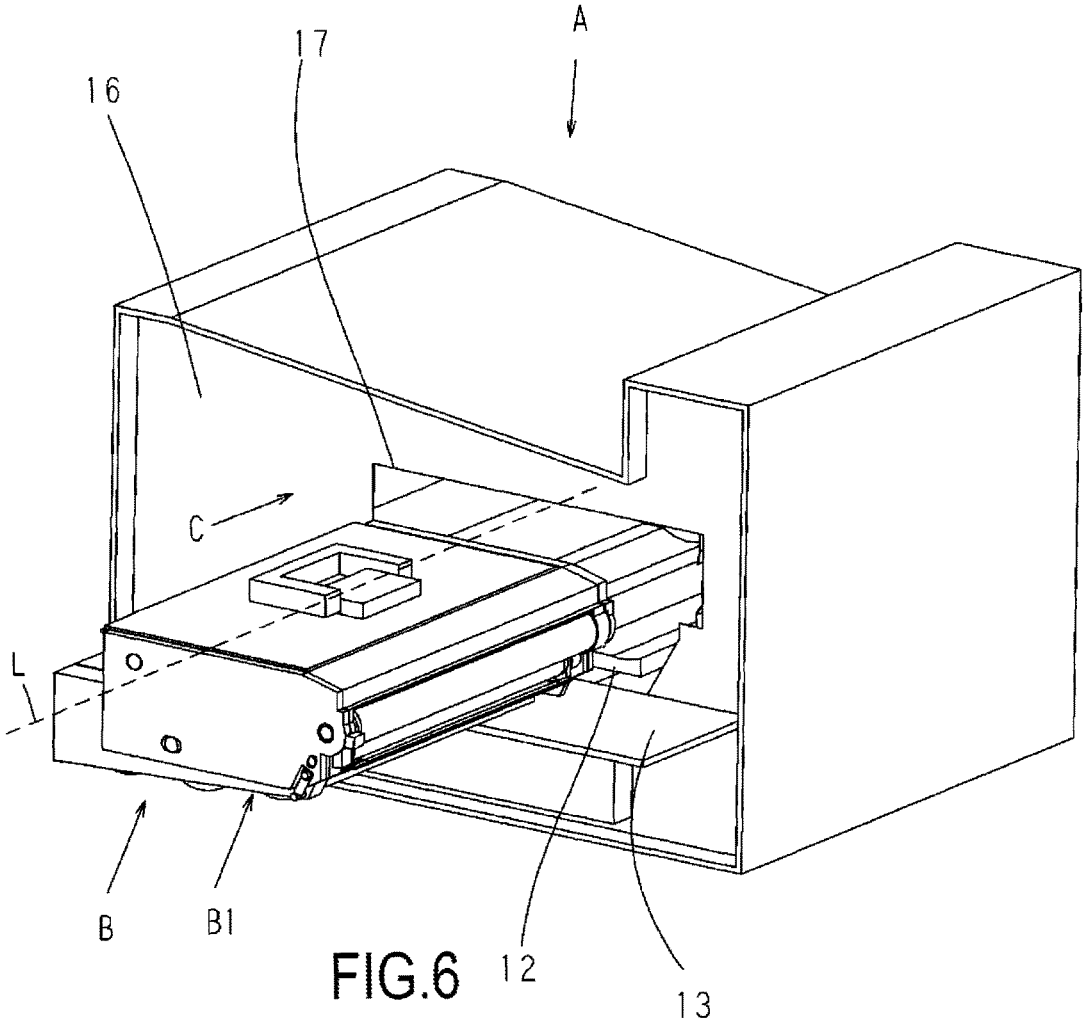
FIG. 6 is a diagram illustrating a state in which a process cartridge is to be attached to an apparatus body of an image forming apparatus.

FIG. 5 is a perspective view of the apparatus body A of the image forming apparatus 1 according to the embodiment. Moreover, FIG. 6 is a diagram illustrating a state in which the cartridge B is to be attached to the apparatus body A of the image forming apparatus 1. Next, an operation of attaching and detaching the cartridge B to and from the apparatus body A of the image forming apparatus 1 will be described with reference to FIGS. 5 and 6.

An opening door 13 is pivotably attached to the apparatus body A. When a user opens the opening door 13, a cartridge attachment opening 17 formed in a non-driving sideboard 16 of the apparatus body A is exposed. Moreover, a cartridge guide 12 that guides the cartridge B into the apparatus body A is formed inside the cartridge attachment opening 17 of the apparatus body A. The cartridge B is guided to the cartridge guide 12 and inserted into the apparatus body A in the direction indicated by arrow C in FIG. 6.

Here, the direction indicated by arrow C is the axial direction of the rotational axis line of the photosensitive drum 62 and the direction from the non-driving side to the driving side. That is, the non-driving side is on the upstream side and the driving side is on the downstream side in the direction in which the cartridge B is inserted into the apparatus body A. A driving shaft 14 that transmits driving force to a driving force receiver 63*a* (see FIG. 3) provided in the cartridge B is provided in the apparatus body A. The driving shaft 14 is driven by a motor (not illustrated) provided in the apparatus body A. Due to this, the photosensitive drum 62 coupled to the driving force receiver 63*a* rotates by receiving driving force from the apparatus body A.

<Carriage of Cartridge B>

Figure 7:
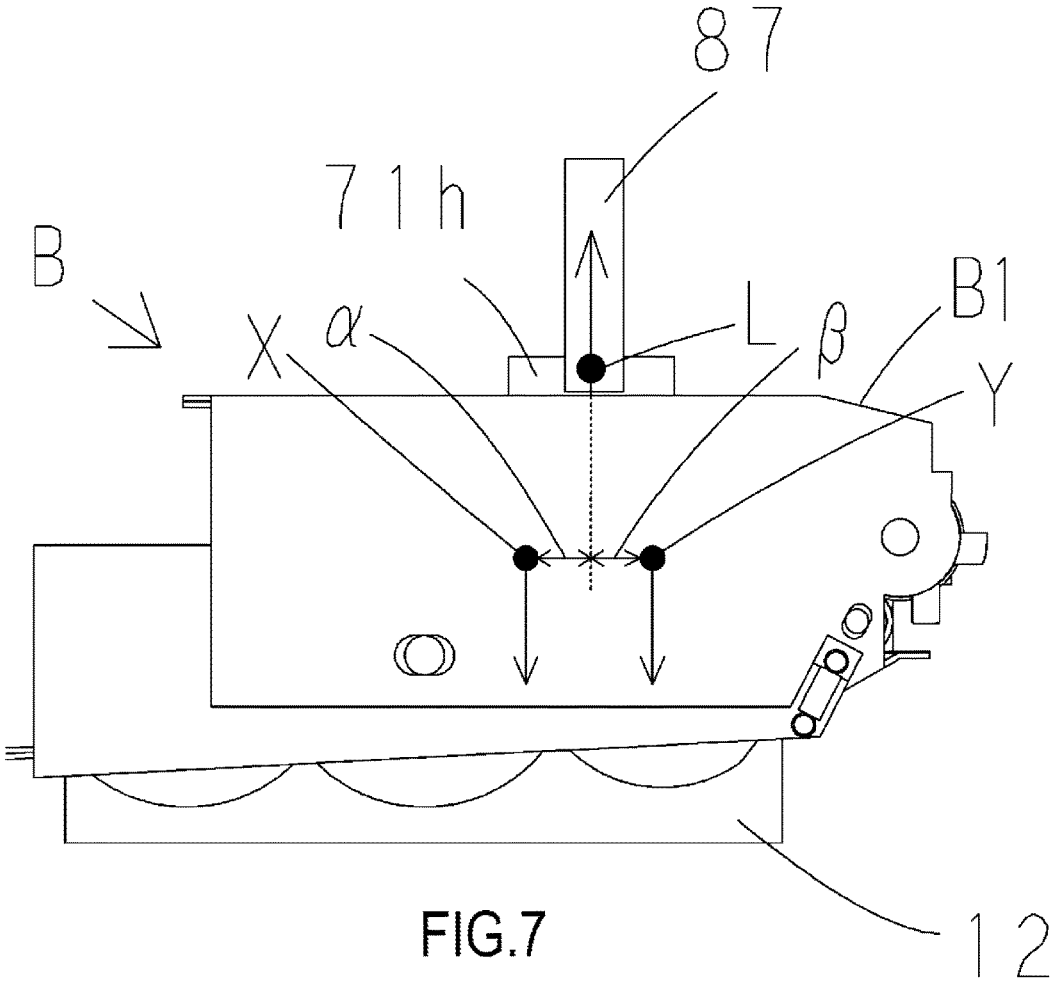
FIG. 7 is a side view of a process cartridge according to the embodiment.
Figure 8A:
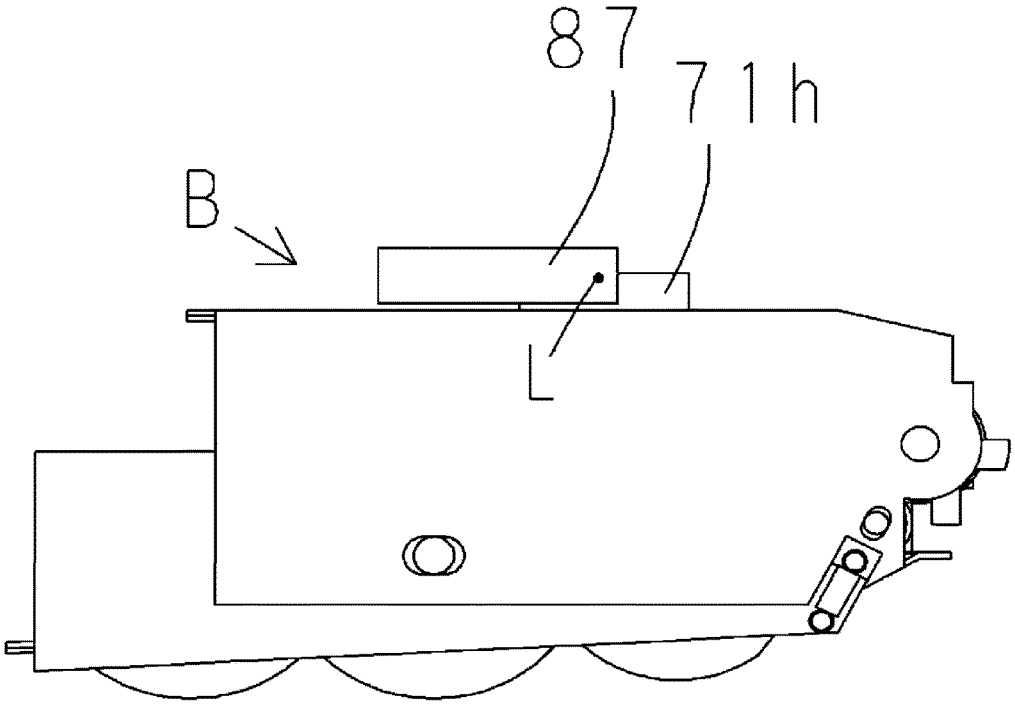
FIGS. 8A and 8B are diagrams illustrating a state in which a handle provided on the process cartridge is pivoted.
Figure 8B:
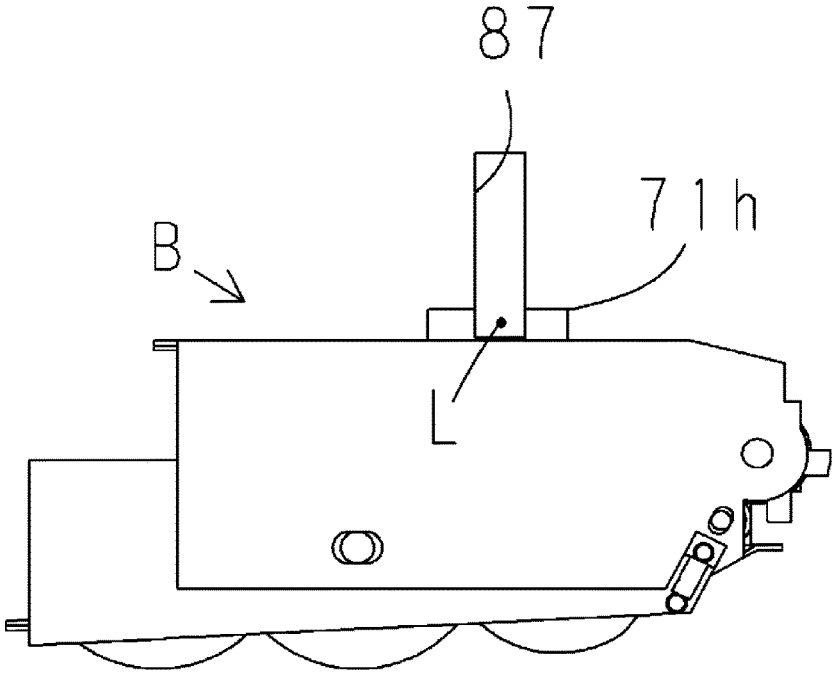
Figure 9A:
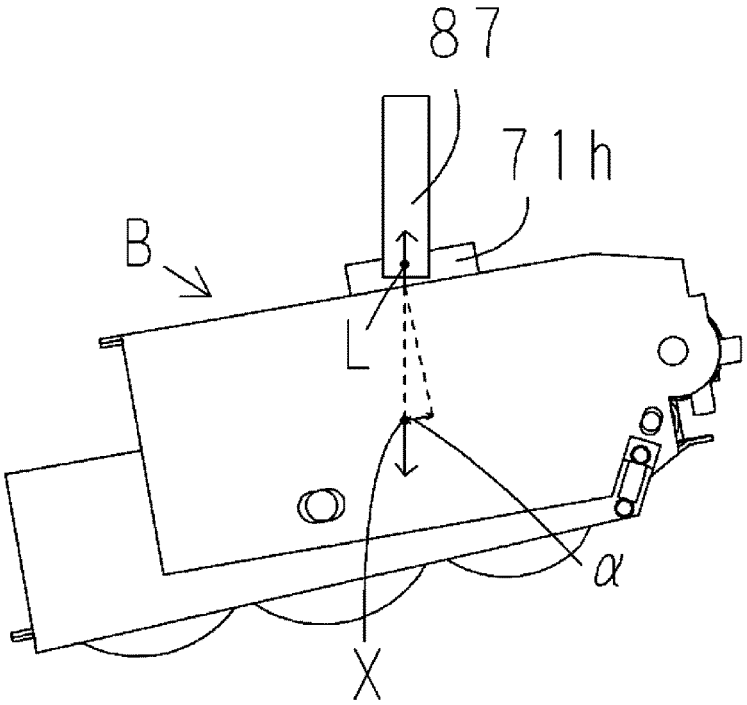
FIGS. 9A and 9B are diagrams illustrating a state of the process cartridge when a handle is grasped.
Figure 9B:
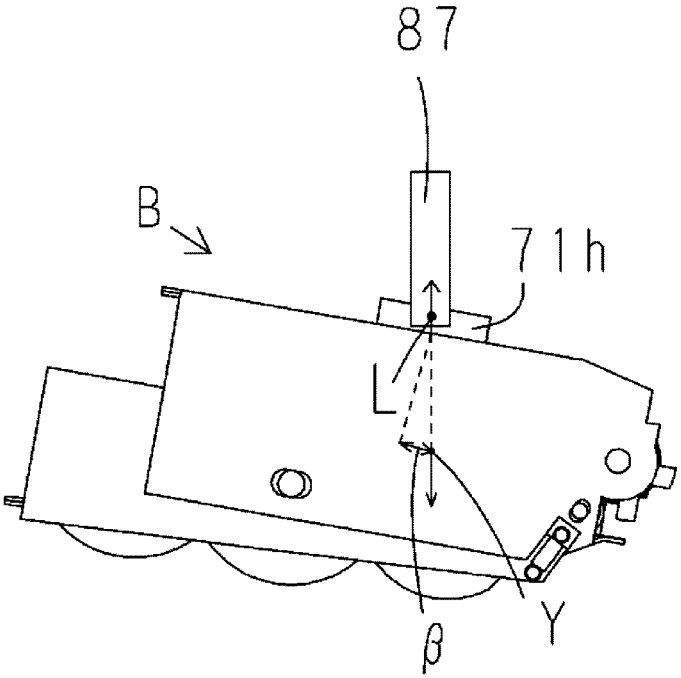
Figure 10A:
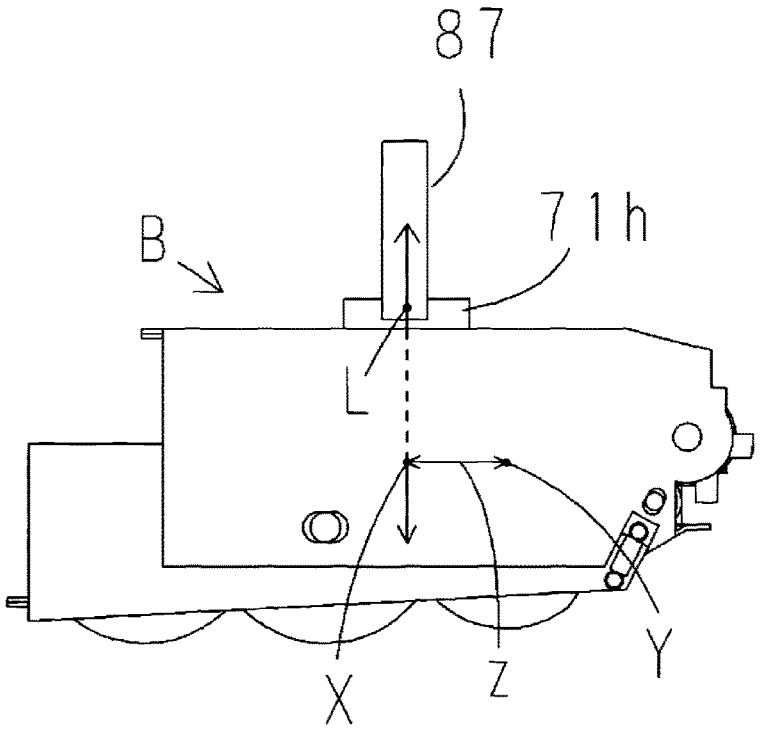
FIGS. 10A and 10B are diagrams illustrating a state of a conventional process cartridge when a handle is grasped.
Figure 10B:
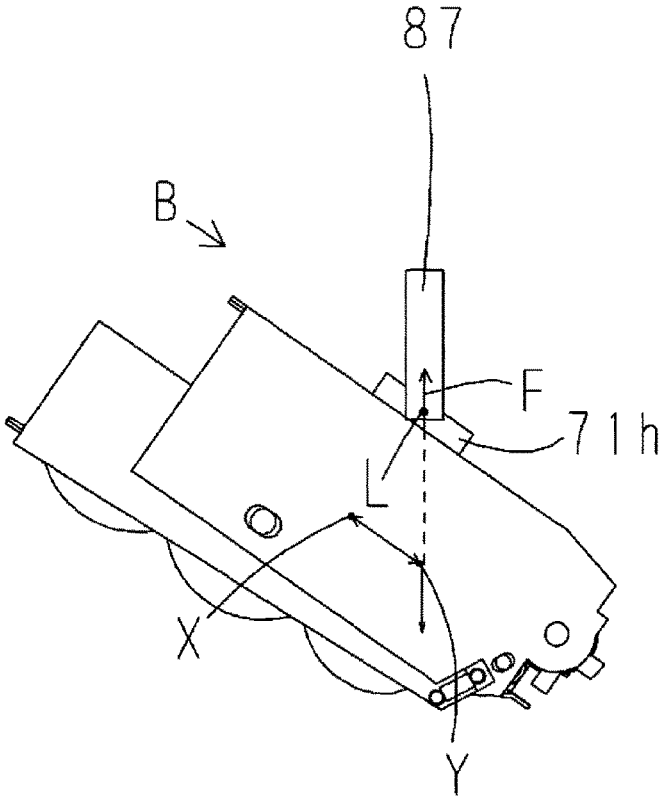

FIG. 7 is a side view of a process cartridge according to the embodiment. FIGS. 8A and 8B are diagrams illustrating a state in which a handle provided on the process cartridge is pivoted. FIGS. 9A and 9B are diagrams illustrating a state of the process cartridge when the handle is grasped. Moreover, FIG. 8A is a diagram illustrating the state of the cartridge B when the cartridge B is attached to the apparatus body A of the image forming apparatus 1. FIG. 8B is a diagram illustrating the cartridge B in the non-used state when the handle 87 is grasped. Moreover, FIG. 9A is a diagram illustrating the state of a non-used cartridge B which is not used when the handle 87 is grasped. FIG. 9B is a diagram illustrating the state of a used cartridge B when the handle 87 is grasped. Next, the attitude of the cartridge B when a user carries the cartridge B while grasping the handle 87 will be described with reference to FIG. 7 to FIGS. 10A and 10B.

Here, the center of gravity of the cartridge body B1 of the cartridge B in a non-used state (hereinafter referred to as a non-used cartridge) is defined as the center X. Moreover, the center of gravity of the cartridge body B1 of the cartridge B in a state in which toner has been consumed (hereinafter referred to as a used cartridge) is defined as the center Y. Further, as described above, the handle 87 provided in the cartridge B is attached to the cartridge B so as to be pivotal relative to the cartridge B. The handle 87 is attached to the cartridge B with a handle supporting portion 71*h* interposed. The handle supporting portion 71*h* pivotably supports the handle 87. Here, the handle 87 pivots about the pivotal axis line L. The pivotal axis line L is parallel to the longitudinal direction of the cartridge body B1 (that is, the rotational axis line of the photosensitive drum 62). Moreover, the handle 87 is provided on an upper portion of the cartridge body B1 in a state in which the cartridge B is attached to the apparatus body A. As described above, in the embodiment, the portion of the cartridge B excluding the handle 87 is referred to as the cartridge body B1.

Here, in the embodiment, when seen from the vertical direction in a state in which the cartridge B is guided by the cartridge guide 12, the center X is positioned closer to one side than the pivotal axis line L of the handle 87, and the center Y is positioned closer to the other side than the pivotal axis line L of the handle 87. Here, the attitude of the cartridge body B1 when attached to the apparatus body A provided on a horizontal surface is referred to as an attached attitude. In the present embodiment, when seen from the vertical direction in the attached attitude, the center X is positioned closer to one side than the pivotal axis line L of the handle 87, and the center Y is positioned closer to the other side than the pivotal axis line L of the handle 87. As described above, the center X is the center of gravity of the non-used cartridge body B1. Moreover, the center Y is the center of gravity of the used cartridge body B1. When seen from the vertical direction in the attached attitude of the cartridge B, the distance between the center X and the pivotal axis line L of the handle 87 is defined as a distance $\alpha$. Moreover, when seen from the vertical direction in the attached attitude of the cartridge body B, the distance between the center Y and the pivotal axis line L of the handle 87 is defined as a distance $\beta$.

Moreover, when seen from the vertical direction in the attached attitude of the cartridge B, the pivotal axis line L of the handle 87 is positioned closer to the photosensitive drum 62 than the center X. Due to this, when a user holds the non-used cartridge B while grasping the handle 87, the cartridge body B1 is inclined so that the center X and the pivotal axis line L of the handle 87 are aligned in the vertical direction as illustrated in FIG. 9A. In this case, the non-used cartridge body B1 is inclined so that the photosensitive drum 62 is positioned on the upper side relative to the horizontal surface. When a user shakes the non-used cartridge B so that the toner in the toner chamber 29 is moved to one side of the photosensitive drum 62, for example, the cartridge body B1 may not be inclined. This is because the center X and the pivotal axis line L of the handle 87 may overlap when seen from the vertical direction. Due to this, when the inclination and the center X of the cartridge body B1 are measured in a state in which the handle 87 is supported, the cartridge B is shaken several times in the attached attitude, and then, the inclination and the center X are checked in a state in which toner is not moved to one side.

Moreover, in the present embodiment, the center Y is positioned closer to the photosensitive drum 62 than the pivotal axis line L of the handle 87. Due to this, when a user holds the non-used cartridge B while grasping the handle 87, the cartridge body B1 is inclined so that the center Y and the pivotal axis line L of the handle 87 are aligned in the vertical direction as illustrated in FIG. 9B. In this case, the cartridge body B1 is inclined so that the photosensitive drum 62 is positioned on the lower side relative to the horizontal surface. When the inclination and the center Y of the cartridge body B1 are measured in a state in which the handle 87 is supported, the cartridge B is shaken several times in the attached attitude, and then, the inclination and the center Y are checked.

In the present embodiment, when the center of gravity of the cartridge B moves before and after the use of the same cartridge B, the distance between the center Y and the pivotal axis line L of the handle 87 when seen from the vertical direction in the attached attitude of the cartridge B decreases as compared to the conventional cartridge. Due to this, the inclination relative to the attached attitude of the used cartridge body B1 can be decreased as compared to a case in which the pivotal axis line L of the handle 87 overlaps the center of gravity of the non-used cartridge body B1 when seen from the vertical direction in the attached attitude of the cartridge B.

Moreover, in the present embodiment, as illustrated in FIG. 9A, when a user grasps the handle 87 of the non-used cartridge B, the cartridge body B1 is inclined so that the side on which the photosensitive drum 62 is not disposed moves downward. In many cases, a user supports the downward inclined side of the cartridge B with a hand other than the hand that grasps the handle 87. However, in the present embodiment, the cartridge body B1 is inclined so that the side on which the photosensitive drum 62 is not disposed moves downward. Due to this, it is possible to suppress the user from touching the photosensitive drum 62 of the non-used cartridge B. As a result, it is possible to suppress damage and contamination of the photosensitive drum 62 of the non-used cartridge B.

Moreover, in the present embodiment, as illustrated in FIG. 2, when the cartridge B is in the attached attitude, the toner chamber 29 and the waste toner chamber 71*b* are disposed to be aligned in the vertical direction. In the present embodiment, a horizontal direction which is the direction in which the toner is conveyed inside the toner chamber 29 is defined as the direction H. Moreover, a horizontal direction which is the direction in which the toner is conveyed inside the waste toner chamber 71*b* is defined as the direction I. When seen from the vertical direction in the attached attitude of the cartridge B, the toner in the toner chamber 29 is conveyed in the direction (H) from the center X to the center Y and the toner in the waste toner chamber 71*b* is conveyed in the direction (I) from the center Y to the center X. Due to this, in the present embodiment, the distance β between the center Y and the pivotal axis line L of the handle 87 when seen from the vertical direction in the attached attitude of the cartridge B decreases as compared to a case in which the directions H and I are in the same direction. As a result, when the handle 87 is grasped by a user, the inclination of the used cartridge B decreases.

As described above, in the present embodiment, when seen from the vertical direction in the attached attitude which is the attitude of the cartridge body B1 (the process cartridge body) when attached to the apparatus body A, the center X (the first center) is positioned closer to one side than the pivotal axis line L of the handle 87. Moreover, when seen from the vertical direction in the attached attitude of the cartridge body B1, the center Y (the second center) is positioned closer to the other side than the pivotal axis line L of the handle 87. Due to this, the inclination relative to the attached attitude of the used cartridge body B1 can be decreased as compared to a case in which the pivotal axis line L overlaps the center X in the vertical direction when the cartridge B is in the attached attitude.

Moreover, in the present embodiment, when seen from the vertical direction in the attached attitude of the cartridge B, the pivotal axis line L of the handle 87 is closer to the photosensitive drum 62 (the image bearing member) than the center X. Due to this, it is possible to decrease the possibility that a user touches the photosensitive drum 62 of the non-used cartridge B.

Moreover, in the present embodiment, the toner chamber 29 (the toner storage chamber) and the waste toner chamber 71*b* (the waste toner storage chamber) are disposed to be aligned in the vertical direction in the attached attitude. Moreover, when seen from the vertical direction in the attached attitude of the cartridge B, the toner stored in the toner chamber 29 is conveyed in the direction from the center X to the center Y. Further, when seen from the vertical direction in the attached attitude of the cartridge B, the toner stored in the waste toner chamber 71*b* is conveyed in the direction from the center Y to the center X. Due to this, when the handle 87 is grasped by a user, the inclination of the used cartridge B decreases.

In the present embodiment, the handle 87 is provided to hold the cartridge B (the process cartridge). However, the present invention is not necessarily limited to this. For example, the handle 87 may be provided in a developing cartridge in which a developing apparatus for developing an electrostatic latent image on the photosensitive drum 62 is provided. In this case, the handle 87 can be disposed in the developing cartridge similarly to the present embodiment. Moreover, a member in which the handle 87 is provided is not limited to the cartridge.

Moreover, in the present embodiment, the handle 87 is rotatably supported on the handle supporting portion 71*h* at two points. However, the present invention is not necessarily limited to this. For example, the handle 87 may rotatably supported on the handle supporting portion 71*h* at three points. The shape of the handle 87 is not limited as long as the pivotal axis line L of the handle 87 is positioned between the center X and the center Y.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133020, filed on Jul. 1, 2015, which is hereby incorporated by reference herein in its entirety.

What is claimed is:

1. A process cartridge capable of being detachably attached to an apparatus body of an image forming apparatus, the process cartridge comprising:

a process cartridge body having a rotatable image bearing member on which a developer image is formed; and a handle attached to the process cartridge body so as to be pivotal relative to the process cartridge body, wherein a rotational axis line of the image bearing member is parallel to a pivotal axis line of the handle, wherein, when the process cartridge is in a non-used state containing developer and the handle is supported an end portion of the process cartridge body that is located on the image bearing member side is positioned above a horizontal plane that includes the rotational axis line, and wherein, when the process cartridge is in a used state where the developer has been consumed and the handle is supported, the end portion of the process cartridge body is positioned below the horizontal plane.

2. The process cartridge according to claim 1, wherein the image bearing member is disposed at a position, at which a user can touch the image bearing member, in a state in which the process cartridge is detached from the apparatus body, and wherein, in an attached attitude, the handle is provided on an upper portion of the process cartridge body.

3. The process cartridge according to claim 1, wherein, when the handle is supported in the non-used state of the process cartridge, the end portion of the process cartridge body is positioned above the horizontal plane, and wherein, when the handle is supported in the used state where replacement of the process cartridge is required, the end portion is positioned below the horizontal plane.

4. A process cartridge capable of being detachably attached to an apparatus body of an image forming apparatus, the process cartridge comprising:

a process cartridge body having a rotatable image bearing member on which a developer image is formed; and a handle provided on the process cartridge body so as to be pivotal relative to the process cartridge body, wherein when seen from a vertical direction in an attached attitude of the process cartridge body when the process cartridge body is attached to the apparatus body, a first center of gravity, which is a center of gravity of the process cartridge body in a non-used state is positioned closer to one side than a pivotal center line of the handle, and a second center of gravity, which is a center of gravity of the process cartridge body from which developer has been consumed is positioned closer to the other side than a pivotal axis line of the handle.

5. The process cartridge according to claim 4, wherein the image bearing member is disposed at a position at which a user can touch the process cartridge in a state in which the process cartridge is detached from the apparatus body, wherein in an attached attitude, the handle is provided on an upper portion of the process cartridge body, and wherein when seen from a vertical direction in the attached attitude, the pivotal axis line of the handle is closer to the image bearing member than the first center of gravity.

6. The process cartridge according to claim 4, wherein the developer image formed on the image bearing member is transferred to a recording medium by a transfer member provided in the apparatus body, and the process cartridge body includes:

a developer bearing member that bears developer for developing an electrostatic latent image formed on the image bearing member;

a toner storage chamber in which developer for forming the developer image is stored;

a first conveying member disposed in the toner storage chamber so as to convey the developer in the toner storage chamber toward the developer bearing member;

a cleaning member that removes the developer remaining on the image bearing member after the developer image is transferred from the image bearing member to the recording medium;

a waste toner storage chamber in which the developer removed by the cleaning member is stored; and a second conveying member that conveys inside the waste toner storage chamber the developer stored in the waste toner storage chamber, wherein the toner storage chamber and the waste toner storage chamber are disposed to be aligned in a vertical direction in the attached attitude, and wherein in the attached attitude and in a horizontal direction, the first conveying member conveys the developer in a direction from the first center of gravity to the second center of gravity and the second conveying member conveys the developer in a direction from the second center of gravity to the first center of gravity.

7. The process cartridge according to claim 4, wherein when seen from a vertical direction in an attached attitude of the process cartridge body when the process cartridge body is attached to the apparatus body, a first center of gravity, which is a center of gravity of the process cartridge body in a non-used state, is positioned closer to one side than a pivotal center line of the handle, and a second center of gravity, which is a center of gravity of the process cartridge body being in a state where a replacement is required due to a consumption of a toner, is positioned closer to the other side than a pivotal axis line of the handle.

* * * * *